US009700808B2

(12) United States Patent
Carroll

(10) Patent No.: US 9,700,808 B2
(45) Date of Patent: Jul. 11, 2017

(54) NOISE MAKING DEVICE

(71) Applicant: Geoffrey Porter Carroll, Maitland, FL (US)

(72) Inventor: Geoffrey Porter Carroll, Maitland, FL (US)

( * ) Notice: Subject to any disclaimer, the term of this patent is extended or adjusted under 35 U.S.C. 154(b) by 64 days.

(21) Appl. No.: 14/018,565

(22) Filed: Sep. 5, 2013

(65) Prior Publication Data

US 2014/0357153 A1 Dec. 4, 2014

Related U.S. Application Data

(60) Provisional application No. 61/855,945, filed on May 28, 2013.

(51) Int. Cl.

| | |
|---|---|
| ***A63H 5/00*** | (2006.01) |
| ***A63H 37/00*** | (2006.01) |
| ***B65D 51/24*** | (2006.01) |

(52) U.S. Cl.

CPC ..... *A63H 5/00* (2013.01); *A63H 37/00* (2013.01); *B65D 51/248* (2013.01)

(58) Field of Classification Search

CPC . A63H 5/00; A63H 33/00; G10K 3/00; G10K 1/00; G10K 1/07; G10K 1/071; B65D 81/365

See application file for complete search history.

(56) References Cited

U.S. PATENT DOCUMENTS

| | | | | | |
|---|---|---|---|---|---|
| 479,636 | A | * | 7/1892 | Droop | G10D 13/006 446/422 |
| 976,718 | A | * | 11/1910 | Bartholome | A63H 5/00 446/422 |
| 1,106,878 | A | * | 8/1914 | Larson | A63H 5/00 446/418 |
| 2,137,651 | A | | 11/1938 | Larrabee | |
| 2,484,159 | A | * | 10/1949 | Flynn, Jr. | A63H 5/00 362/102 |
| 2,509,851 | A | * | 5/1950 | White | A47G 19/2227 116/155 |
| 2,597,522 | A | * | 5/1952 | Pierce | A47G 19/2227 116/152 |
| 2,749,659 | A | * | 6/1956 | Elstein | 446/422 |
| 2,874,670 | A | * | 2/1959 | Zenchenko | A47G 19/2227 116/67 R |
| 2,961,796 | A | | 11/1960 | Davis | |
| 3,051,341 | A | * | 8/1962 | Mead | A61J 9/00 215/11.1 |
| 3,516,193 | A | * | 6/1970 | Engelman | A63H 33/00 33/27.11 |
| 3,909,977 | A | | 10/1975 | Kirk | |

(Continued)

*Primary Examiner* — Gene Kim
*Assistant Examiner* — Alyssa Hylinski
(74) *Attorney, Agent, or Firm* — Beusse, Wolter, Sanks, & Maire, PLLC; Ferdinand M. Romando

(57) ABSTRACT

Apparatus for use with a bottle or other tube structure including a wall which extends from a first end to a second end. A cover piece is attachable to the tube structure along one end about a tube opening. One end of a rod member is attached to the cover piece. With a mass attached to a second end of the rod member, when the second rod member end and the mass are positioned within the tube, the rod member and the mass can be swung within the tube, causing the mass to hit the wall.

19 Claims, 14 Drawing Sheets

(56) References Cited

U.S. PATENT DOCUMENTS

| | | | | | |
|---|---|---|---|---|---|
| 3,921,331 | A * | 11/1975 | Schatz | A63H 15/06 | 446/297 |
| 4,522,604 | A * | 6/1985 | Stubbmann | A63H 15/00 | 446/219 |
| 4,547,172 | A * | 10/1985 | Kino | A63H 15/00 | 446/421 |
| 4,930,645 | A * | 6/1990 | Warehime | A63H 33/00 | 215/11.1 |
| 5,112,266 | A | 5/1992 | Hall | | |
| 5,114,375 | A * | 5/1992 | Wellhausen et al. | 446/246 | |
| 5,135,233 | A * | 8/1992 | Leas | A63B 67/10 | 446/121 |
| 5,322,036 | A * | 6/1994 | Merino | A63H 15/04 | 119/707 |
| 5,483,764 | A * | 1/1996 | Lin | G09F 19/08 | 40/411 |
| 5,571,037 | A | 11/1996 | Sellers | | |
| 5,813,899 | A * | 9/1998 | Hartley | G10K 3/00 | 446/422 |
| 5,984,761 | A | 11/1999 | Kalinowski | | |
| 7,325,357 | B2 * | 2/2008 | Wiskur | A01K 85/01 | 43/17.1 |
| 2002/0012689 | A1 | 1/2002 | Stillman | | |
| 2004/0206224 | A1 | 10/2004 | Cohen | | |
| 2009/0025648 | A1 | 1/2009 | Simon | | |

* cited by examiner

NOISE MAKING DEVICE

PRIORITY BASED ON RELATED APPLICATION

This application claims priority from U.S. Provisional Application No. 61/855,945 filed May 28, 2013.

FIELD OF THE INVENTION

The present invention relates to noise making devices of the type used for attendees of events and celebrations and, more particularly, to an apparatus manually operable in conjunction with a container or other tubular structure to generate sound.

BACKGROUND OF THE INVENTION

During competitive games and other types of events held in large venues, groups of people often make efforts to generate loud expressions of enthusiasm or to cheer for a sports team, or to audibly affirm a person or a cause. However, persons desiring to generate such expressions often find themselves limited generating vocal expressions of limited duration and volume. While various devices are available to otherwise generate expressive sounds, these are often large or cumbersome to carry and are normally not available for purchase at the venue. It is desirable to provide an apparatus which can easily be made available at such events for a nominal cost.

BRIEF DESCRIPTION OF THE INVENTION

According to one embodiment of the invention, there is provided an apparatus for use with a tube structure having first and second opposing ends. At least one of the ends of the tube structure includes an opening that can be covered. The structure includes a wall which extends from the first end to the second end. The apparatus includes a cover piece configured to be attached along one of the ends to cover or close the opening by placement of the cover piece in or about the opening. The apparatus also includes at least a first rod member having first and second opposing ends with the first rod member end attached to the cover piece and the second rod member end positioned away from the cover piece. A first mass is attached to the second end of the rod member, so that when the second rod member end and the mass are positioned within the tube, the rod member and the mass can be swung within the tube, causing the mass to hit the wall.

BRIEF DESCRIPTION OF THE DRAWINGS

The present invention and uses thereof will be more readily understood when the following detailed description of the present invention is read in conjunction with the figures wherein:

FIG. 1A is a perspective view of the assembly prior to insertion in a beverage container, FIG. 1B provides a partial cut-away view of components in the noise-making assembly, including a cap portion suitable for the embodiments of FIG. 1 and FIG. 4, and FIG. 1C is a perspective view of the assembly positioned in the beverage container;

FIG. 1D is a perspective view of the assembly prior to insertion in a beverage container, and FIG. 1E is a perspective view of the assembly positioned in the beverage container;

FIGS. 3A through 3D illustrate features of a noise-making assembly according to another embodiment of the invention, with:

FIG. 3A providing a perspective view of the assembly incorporating a stopper in lieu of a threaded cap, FIG. 3B providing a view from above of the stopper, FIG. 3C providing a sectional view of the stopper along line 3C-3C of FIG. 3B, and FIG. 3D providing a perspective view of the assembly positioned in the beverage container;

FIGS. 4A and 4B illustrate features of a noise-making assembly according to another embodiment of the invention, with:

FIG. 4A providing a perspective view of the assembly incorporating a handle in addition to a threaded cap, and FIG. 4B providing a perspective view of the assembly positioned in a beverage container;

FIG. 7A is a view illustrating a major side of the rod member, FIG. 7B is a view illustrating a minor side of the rod member.

To the extent the described device features are not drawn to scale in the figures, they facilitate illustration of specific features relevant to the invention. Like reference characters denote like elements throughout the figures and text.

DETAILED DESCRIPTION OF THE INVENTION

Figure 1A:
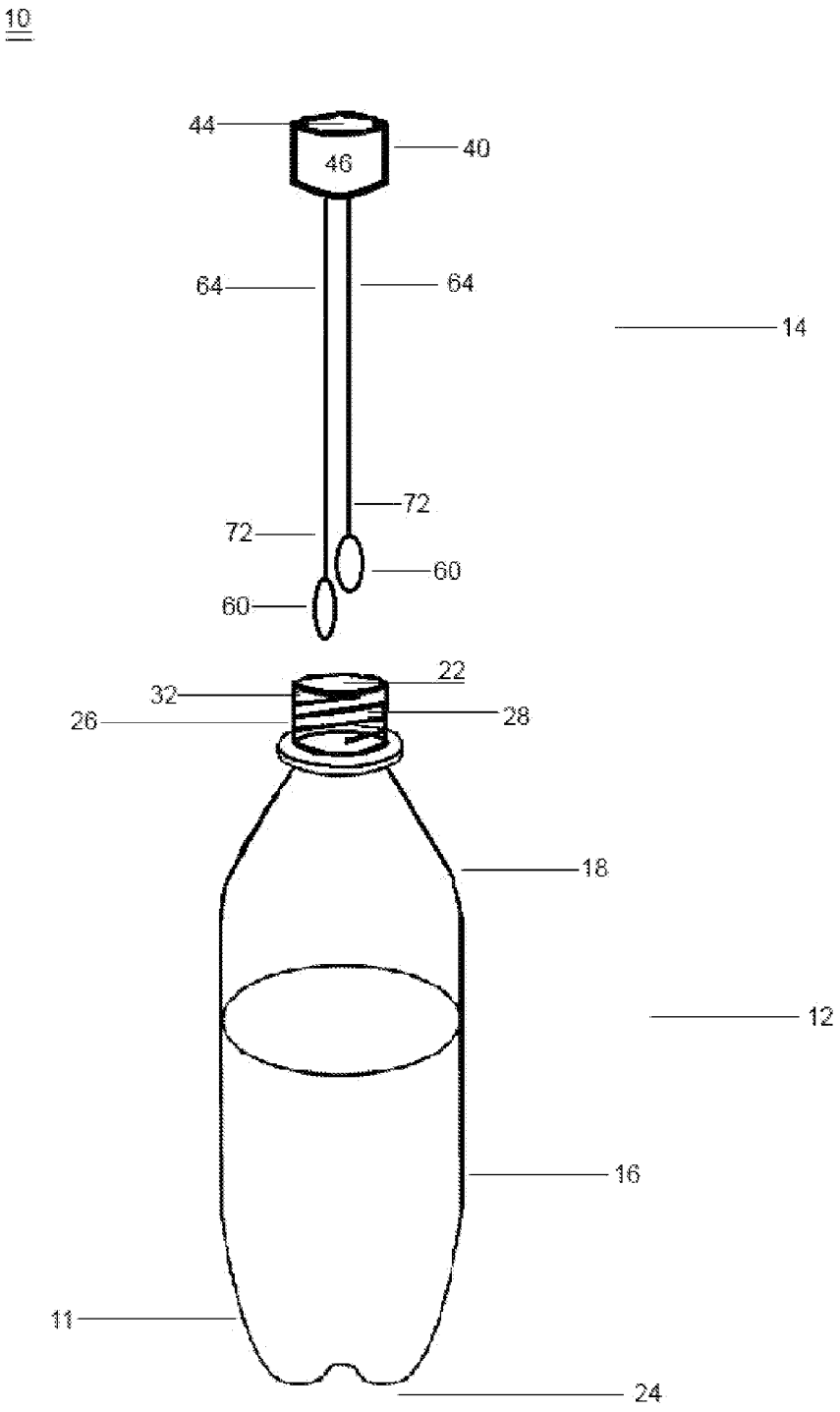
FIGS. 1A through 1C illustrate an embodiment according to the invention, comprising a noise-making assembly illustrated in conjunction with a beverage container, where.

Before describing in detail exemplary systems and methods relating to the invention, it should be observed that the present invention resides in a novel and non-obvious combination of elements and method steps. So as not to obscure the disclosure with details that will be readily apparent to those skilled in the art, certain conventional elements and steps may be presented with lesser detail, while the drawings and the specification describe in greater detail other elements and steps pertinent to understanding the intended scope and embodiments of the invention. Also, the following embodiments are exemplary constructions which do not define limits as to structural arrangements or methods according to the invention. The now described embodiments are exemplary and permissive rather than mandatory and are illustrative rather than exhaustive.

As used herein, the term tube refers to a structure having one or more wall portions extending around or enclosing a volume. Exemplary tube structures include conventional bottles used to dispense liquids, e.g., bottled refreshments. Many beverage bottles are suitably designed for a consumer to drink the refreshment directly from the bottle, i.e., without first pouring the beverage into a cup or glass. Generally, one class of beverage bottles has a neck opening, for dispensing or drinking the contents, positioned along a relatively narrow, low volume neck formed in an upper portion of the bottle. The neck merges into a lower container portion which typically defines a sufficiently large volume that holds the majority of liquid stored in the bottle. The typical beverage bottle or container has first and second closed tube ends. The first closed end often includes a removable cap or other closure device positioned around or in the neck opening. Typically, the second closed end is integrally formed as part of the lower container portion. The shape of the second integrally formed end often facilitates standing the container on the second end to achieve a stable orientation so the neck portion extends above the second end. This renders a stable erect position when the bottle is placed on a flat, level surface.

Typically a consumer beverage bottle, of the type that a person drinks from directly, is designed to be hand-held. With placement of a hand about the lower container portion the bottle can be securely held while drinking. On the other hand, a feature of the typical consumer beverage bottle is that a person can hold the container by the neck with one hand. The hand can be positioned on the neck of the container to provide a degree of leverage that facilitates swinging or waiving the bottle in an inverted or other non-erect orientation.

The term rod member as used herein refers to an elongate member having opposing ends defining a length of relatively large dimension and a thickness having a relatively small dimension where, for example, the ratio of length to thickness may range from 30:1 to 80:1. A rod member may be flexible, or have resilience such as is characteristic of a spring-like member. A rod member may be formed of wire, fiberglass, plastic metal, fiber or a resin composite material.

Figure 1B:
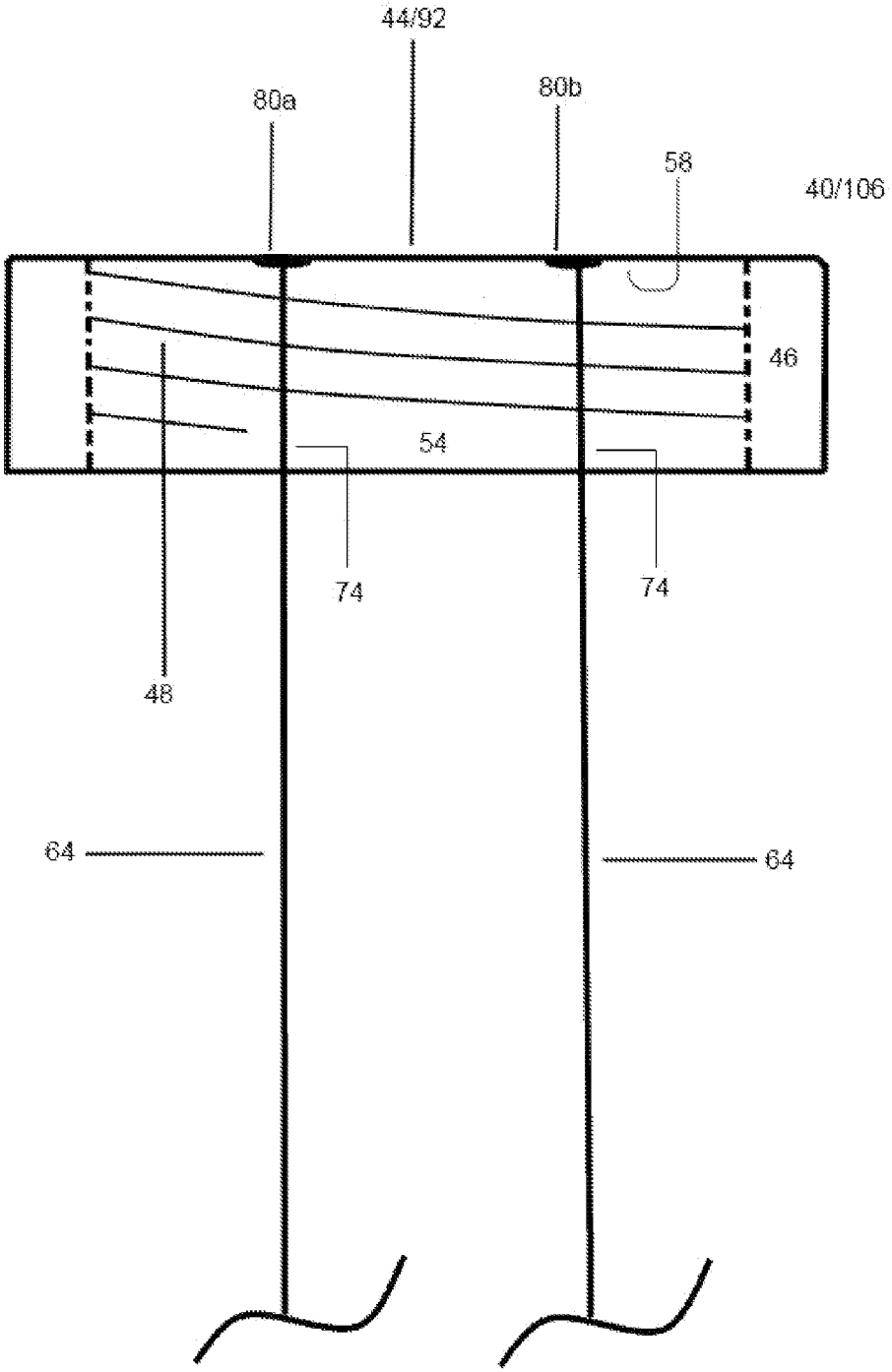
Figure 1C:
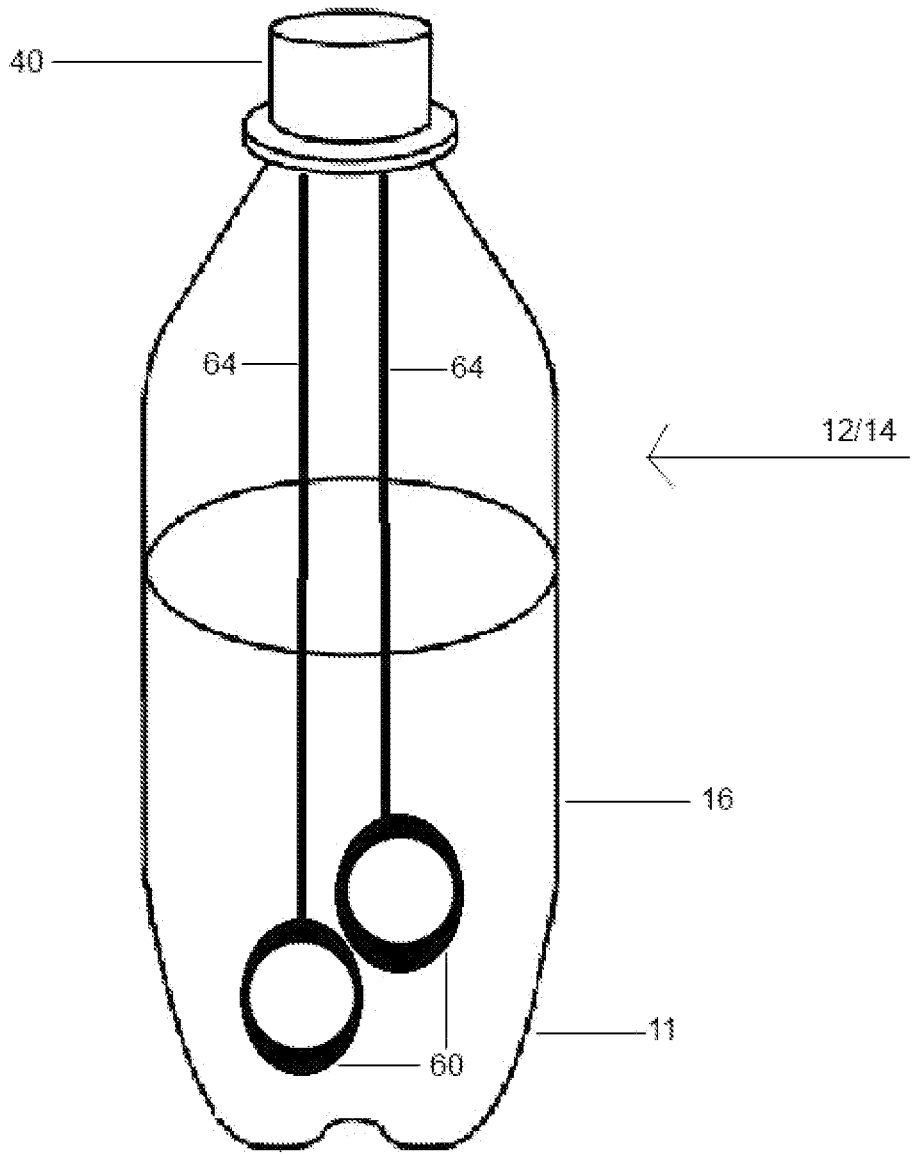

With reference to FIGS. 1A through 1C, there is shown an embodiment 10 according to the invention, comprising a consumer beverage bottle 12 and a noise-making assembly 14 insertable within the bottle 12. The bottle 12 may be of any conventional type, but the illustrated bottle is of the type typically formed with a continuous wall 11 of molded plastic. The bottle is of an exemplary design having a relatively wide container portion 16 extending upward into a narrowing neck region 18. The neck region terminates at an opening 22 while the bottle also includes a closed end 24 bounding the container portion along a bottom portion or underside of the bottle. The opening, through which a beverage contained in the bottle may pass, is positioned at a first end 26 of the bottle which is opposite the closed end 24 of the bottle. For embodiments which utilize a bottle having contained a beverage, it is to be understood that the first end 26 of the bottle may be designed to be closed with any of a variety of well-known container closures (not shown), referred to as cover pieces, such as bottle caps, stoppers and the like. In the illustrated example, the first end 26 includes screw-on bottle threads 28 along an exterior surface 32 of the end 26 for receiving mating threads formed along an inner wall of a cap so the cap may be screwed on to the first end 26 and thereby seal the contents stored within the bottle 12. In other embodiments, including bottles formed of a more rigid material than plastic, e.g., glass, the first end 26 may be contoured about the opening 22 to receive a malleable metal cap which stays affixed to the bottle when the bottle contains contents under pressure. In still other embodiments, the bottle is designed to receive a flexible (e.g., rubber-like) stopper, or a cork, insertable within the opening 22 to prevent movement of fluid out of the bottle.

As shown in FIG. 1A, the noise-making assembly 14 comprises a cover piece in the form of a cap 40 having a flat, circular shaped top 44 and a cylindrically shaped wall 46 extending from the cap top 44. When installed on the bottle 12, the cap 40 fits about the first end 26 with the cap top covering the opening 22 and the with the cylindrically shaped wall 46 extending along the first end 26 of the bottle. In this embodiment, with the first end 26 of the bottle 12 having the screw-on threads 28 along the exterior surface 32 of the end 26, the cap 40 includes mating threads 48 formed along an interior surface 54 of the cap wall 46 for engaging the threads 28. With this arrangement the cap 40 may be screwed on to the first end 26. FIG. 1B is a partial cut-away view of the cap 40 illustrating the cap threads 48, as well as an interior surface 58 of the circular shaped cap top 44 which adjoins the interior wall surface 54.

It is to be understood that, although the cap 40 may close or seal the opening 22 of the bottle 12, this is an optional, incidental feature which is not essential to embodiments of the invention. The combination of the threaded first end 26 of the bottle 12 and the threaded cap 40 provides a secure mounting arrangement of the noise-making assembly when portions of the assembly 14 are inserted within the bottle 12 as shown in FIG. 1C.

The noise-making assembly 14 further includes one or more masses 60, e.g., knockers, each connected to a rod member 64 which, in turn, is connected to the cap 40. The rod members 64 are attached to the cap 40 along the interior surface 58 of the circular shaped cap top 44. In the example embodiment 10, the assembly 14 comprises two rod members 64, each having first and second opposing ends 72, 74 by which the rod member connects a mass 60 to the cap 40. The first end 72 of each rod member is connected to a different one of the two masses 60 and the second end 74 of each rod member is connected to the cap 40. Other arrangements of the assembly 14 may include more than two masses 60 or more than one mass 60 attached to each rod member 64.

As illustrated in FIG. 1B, the rod ends 74 are connected to the cap top 44 at fixation points 80*a*, 80*b* along the interior surface 58 of the circular shaped cap top 44. Connection of the rod ends 74 to the cap can be effected with one of numerous well known bonding or mechanical fastening techniques, including formation of a bond under pressure or elevated temperature, chemical bond formation, and use of a wide variety of fasteners and fastening or locking techniques. With a mass 60 attached to each second rod member end 72, and the rod member 64 attached to the cap 40, the mass 60 can be suspended from the cap 40, (e.g., under the force of gravity) while the combination of mass 60 and rod member 64 may be swung about one of the fixation points 80*a*, 80*b*.

FIG. 1C illustrates the noise-making assembly 14 positioned in the bottle 12 after passing the masses 60 and major portions of the rod members 64 through the bottle opening 22 and turning the cap 40 to engage the cap threads 48 with the screw-on bottle threads 28. The rod members 64 are of sufficient length that when the cap 40 has been turned to fully engage the threads 28 and 48 with one another and securely attach the cap 40 to the bottle, the masses 60 are suspended in the wide container portion 16 of the bottle where they can undergo motion such as a swinging movement within the volume enclosed by the wall 11.

Figure 1D:
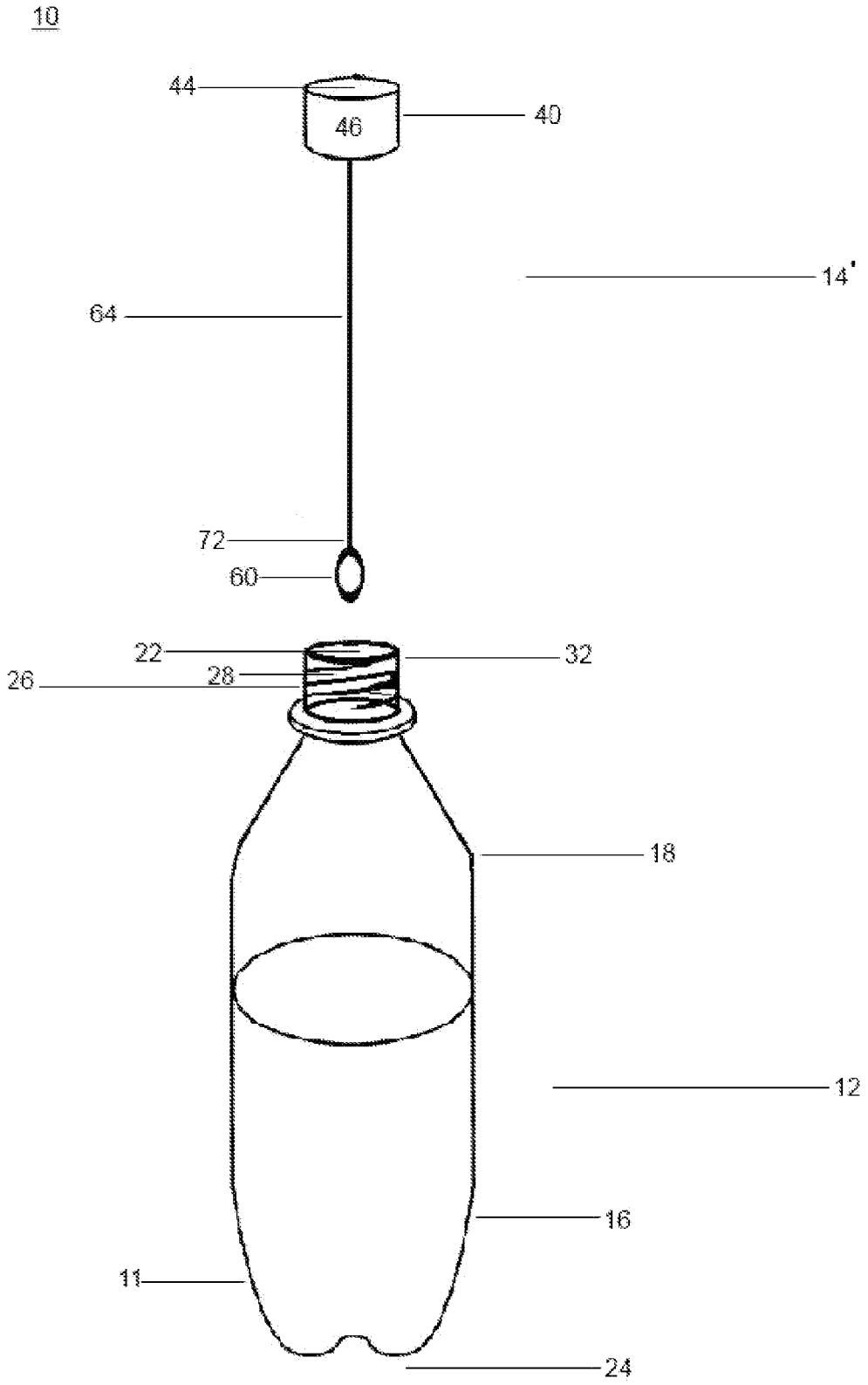
FIGS. 1D and 1E illustrate another embodiment according to the invention, comprising an alternate embodiment of a noise-making assembly illustrated in conjunction with a beverage container, where.
Figure 1E:
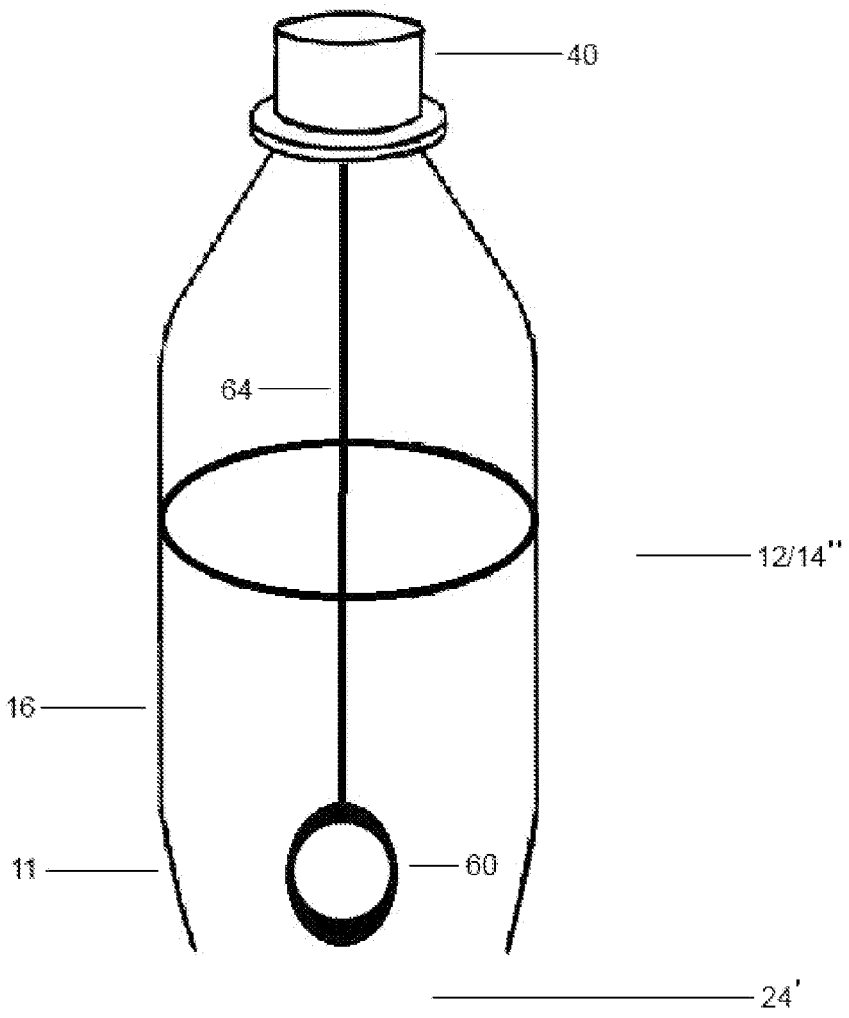

FIGS. 1D and 1E illustrate other embodiments of a noise making assembly according to the invention, where like reference numbers indicate like components described in FIGS. 1A through 1C. FIG. 1D is a perspective view of a noise making assembly 14' prior to insertion in a beverage container, and FIG. 1E is a perspective view of a noise making assembly 14" comprising a beverage container 12'. The noise-making assembly 14' is similar to the embodiment of FIGS. 1A through 1C except that the assembly 14' includes only one rod member 64 attached to the cap 40 with a single mass 60 attached to the rod member end 72 so that only a single mass 60 may be suspended from the cap 40. The assembly 14' comprises the afore described cap 40 which fits about the first bottle end 26 to cover a bottle opening 22 with the cylindrically shaped wall 46 extending along the first end 26 of the bottle. As has been described for the assembly 14, with the first end 26 of the bottle 12 having the screw-on threads 28 the cap 40 may be screwed on to the first end 26.

To be distinguished from the embodiment shown in FIG. 1B, the interior surface 58 of the cap 40 has one fixation point 80*a* to which the end 74 of the one rod 64 is connected along the interior surface 58 of the cap top 44. With the single mass 60 of the assembly 14' attached to the end 72 of the single rod member 64, the mass 60 can be suspended from the cap 40 in the wide container portion 16 of the bottle (e.g., under the force of gravity) and the combination of only one mass 60 and only one rod member 64 may be swung about the one fixation point 80*a* within the volume enclosed by the bottle wall 11.

The noise-making assembly 14" is similar to the embodiment of FIG. 1D except that the assembly 14" includes a bottle 12' which, in place of having the single closed end 24, has two open ends, i.e., an opening 22 along the neck region 18 and an open end 24' bounding the container portion along a bottom portion or underside of the bottle.

Figure 2:
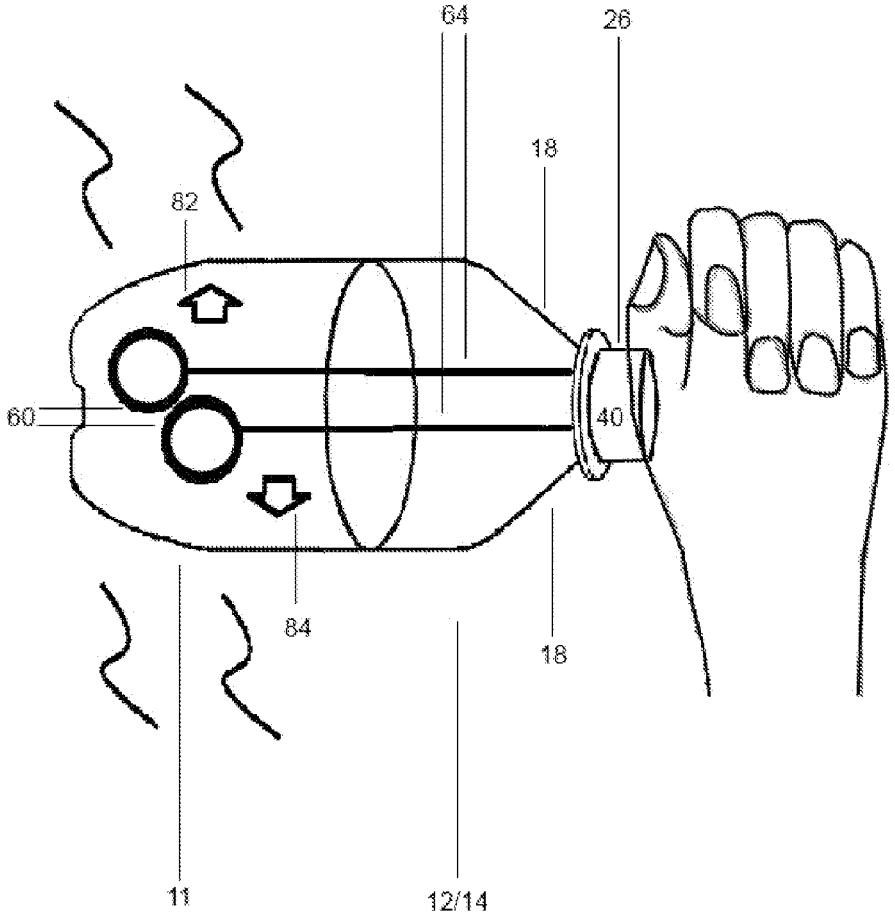
FIG. 2 illustrates orientation of a hand position with respect to a bottle for holding the bottle containing the noise-making assembly 14.

FIG. 2 illustrates a hand position orientation for holding a bottle containing the noise-making assembly 14. The bottle is shown in spaced-apart relation to the hand. A hand may grasp the cap 40 or, a position along the first end 26, or a position along the narrowing neck region 18 of the bottle 12 in order to impart motion to the masses 60. For example, with a bending or turning motion of the wrist while the bottle is being so held by the hand, the masses may be swung back and forth within the bottle 12. A characteristic of the rod member, or a characteristic of attachment of the rod member to the cover piece, enables the rod member second end to swing within the tube structure, allowing the mass to collide with the wall of the tube structure. The arrows 82, 84 indicate exemplary alternate directions of movement imparted to the masses 60 when the bottle is so held with a hand and is swung based on movement of the adjoining wrist or arm. With such movement the rod members 64 can undergo pivotal movement about the fixation points 80*a*, 80*b* with the masses 60 swinging to repeatedly strike the wall 11. As the masses strike the wall 11 impulsive sounds are generated. A rapid repetition of impulsive sounds can be had by rapidly and continuously swinging the bottle 12 with a back and forth, e.g., reciprocating, motion to impart back and forth motion of the masses with respect to the bottle. This causes the masses to repeatedly strike the wall 11.

FIGS. 3A through 3D illustrate features of a noise-making assembly 14*a* according to a third embodiment of the invention. In lieu of providing the cap 40, the masses 60 and rod members 64 are suspended from a stopper 90. As shown in the figures, the exemplary stopper may have a slightly tapered profile in which an upper stopper surface 92 has a greater outside dimension than a lower stopper surface 94. When the stopper 90 is installed in a bottle opening 22 the upper stopper surface 92 is positioned along the first bottle end 26 near the opening 22 (e.g., outside the opening), while the lower stopper surface 94 is positioned within the bottle interior along or adjacent the neck region 18 and near the opening 22.

Figure 3A:
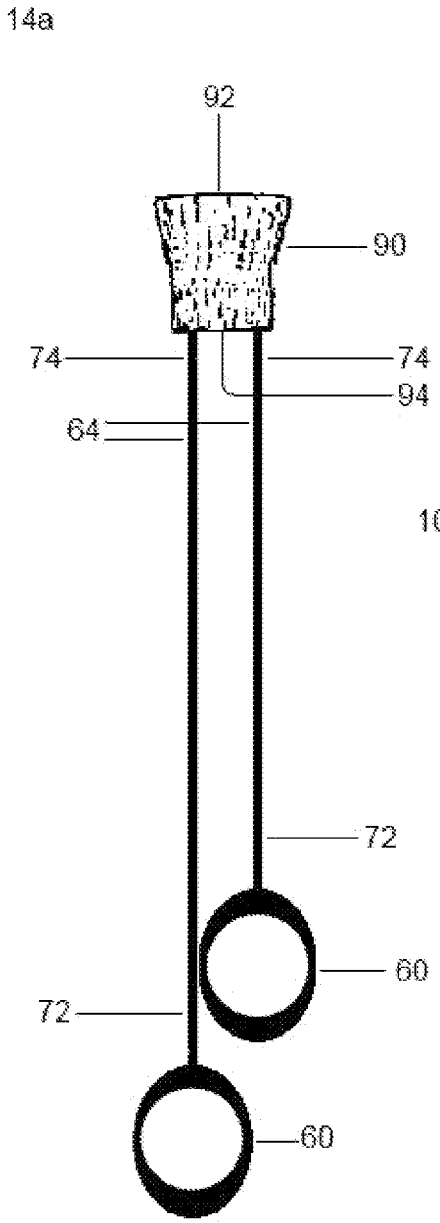
Figure 3B:
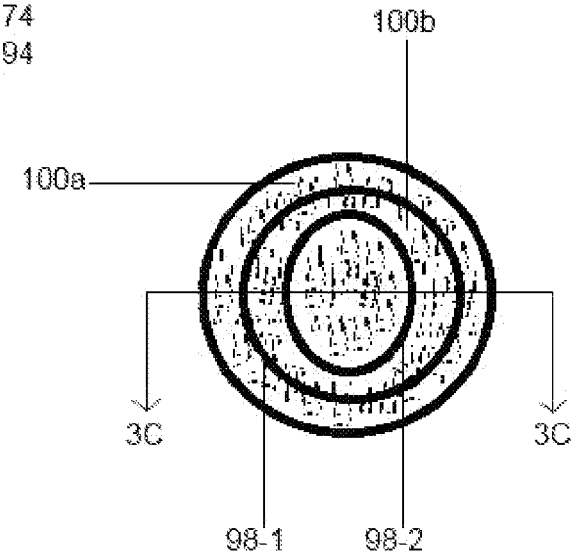
Figure 3C:
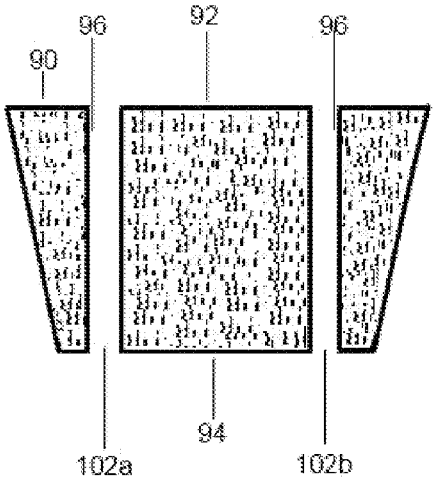
Figure 3D:
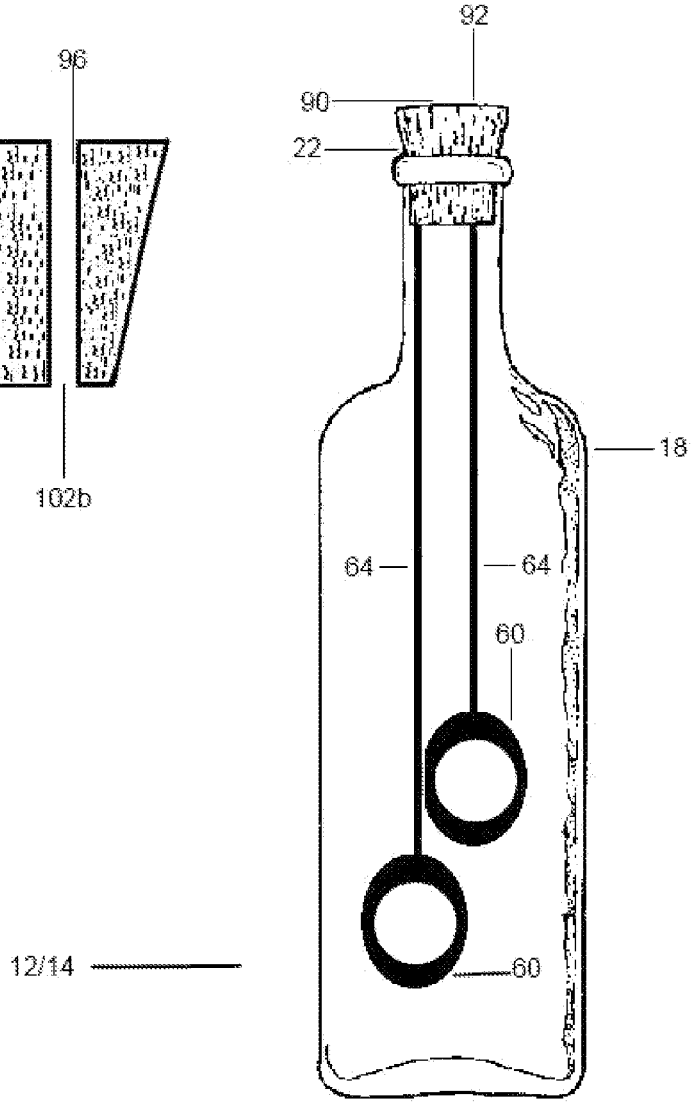

The stopper 90 may comprise a size-adjustable rubber-like mass or a cork body to accommodate variations in size of the bottle opening 22 among bottles of differing designs. As shown in the view of FIG. 3B, taken along the upper stopper surface 92, the stopper 90 may be formed in a pre-cut pattern, i.e., having a series of partial cuts $\mathbf{98}_i$ (e.g., $\mathbf{98}_1$, $\mathbf{98}_2$) defining varying outside dimensions, e.g., outside diameters, for the stopper 90. A user of the assembly 14*a* may then reduce the outside dimension of the stopper 90 by peeling or otherwise removing outer portions 102*a* or 102*b* of the stopper along a pre-cut pattern $\mathbf{98}_i$ to more appropriately fit the stopper within the opening 22. In this and other embodiments of the noise-making assembly, the second ends 74 of the rod members 64 can be affixed by forming a pair of holes 96 which extend partly or entirely through the mass as shown for the stopper 90 in FIG. 3C. Each hole 96 extends upward from the lower stopper surface 94, near a fixation point 102*a*, 102*b*, and toward or to the upper stopper surface 92. As described for the fixation points 80*a*, 80*b* shown in FIG. 1B, by continuously swinging the bottle 12, the rod members 64 can undergo pivotal movement about the fixation points 102*a*, 102*b*, which movement causes the masses 60 to swing and repeatedly strike the wall 11 and to thereby generate a series of impulsive sounds.

Figure 4A:
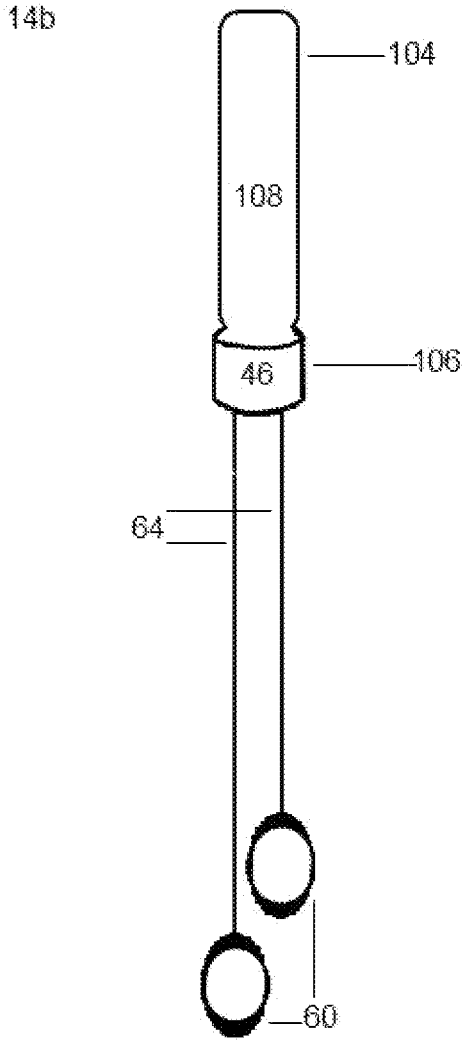
Figure 4B:
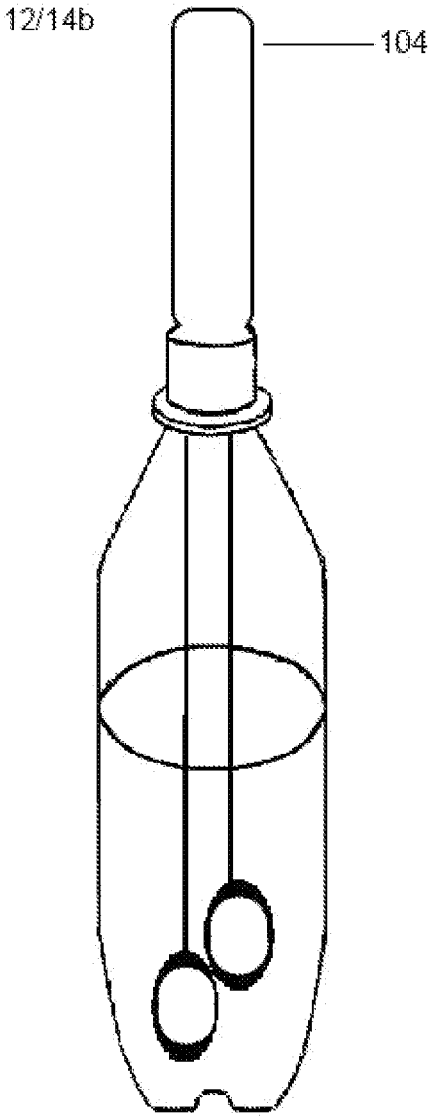

In addition to providing masses 60 and rod members 64 suspended from a cap 40 or a stopper 90, a noise-making assembly 14*b* according to a fourth embodiment of the invention includes a handle 104. The handle 104 may extend from the upper surface 44/92 of a cap or a stopper and may be integrally formed with the cap or stopper, e.g., in a molding process. FIGS. 4A and 4B illustrate one example of the assembly 14*b* comprising a cap 106, having features like the cap 40. With reference to FIG. 1B, the cap 106 includes the cylindrically shaped wall 46 and an interior surface 58 of the circular shaped cap top 44 which adjoins the interior wall surface 54. The cap 106 also includes mating threads 48 formed along the interior surface 54 of the cap wall 46. With this arrangement the cap 40 may be screwed on to the first end 26 of the bottle 12 in like manner to that described for the cap 40 with reference to FIG. 1.

Like the embodiment 10, the rod members 64 of the noise-making assembly 14*b* are attached to and extend away from fixation points 80*a*, 80*b* to suspend the masses 60 from the cap 106. The handle 104 extends in a direction away from the rod members 64 and masses 60. In one implementation, the handle 104 may be integrally formed with the cylindrically shaped wall of the cap 106, e.g., as an extension of the cap wall 46. When the handle 104 and cap 40 are integrally formed, e.g., in a molding process, the portion corresponding to the cap wall 46 shown in FIG. 1 is a portion of a larger wall 108 which provides the handle 104 as well.

With the handle 104 extending away from the bottle opening 22, the hand position shown in FIG. 2 for holding a bottle 12 containing a noise-making assembly may also be applied to the handle 104. Instead of applying the hand to the first bottle end 26 or the narrowing neck region 18 of the bottle, the hand may grasp the handle 104 to impart motion to the masses 60 (e.g., with bending or turning motion of the wrist or forearm).

To impart strength and stiffness to the handle 104, and thereby minimize deformation due to bending moments about the opening 22, the portion of the wall 108 which extends from the upper surface 44/92 of the cap 40 may be a solid structure while the portion of the wall 108 which forms the cap wall 46 is hollow in order to position the cap about the bottle opening 22.

Figure 5:
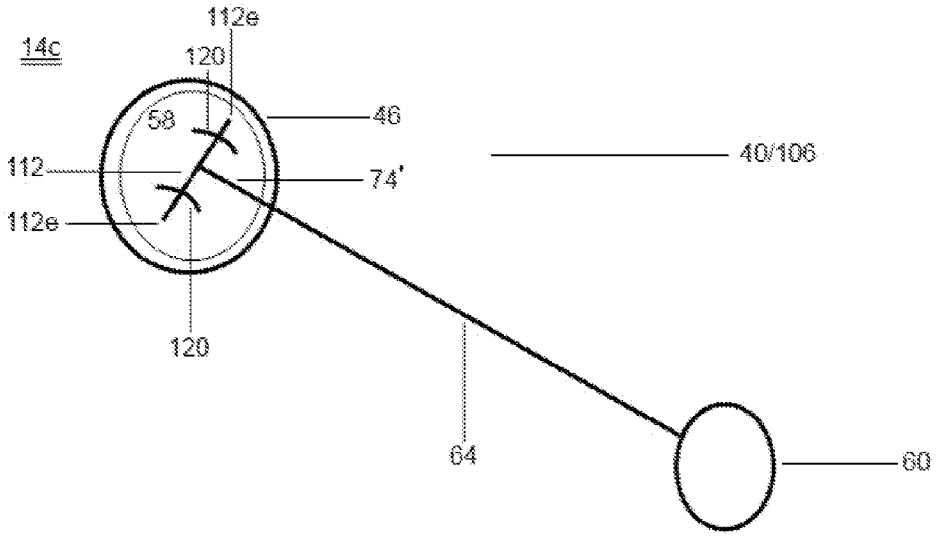
FIG. 5 is a perspective view of another embodiment of an assembly according to the invention showing an interior surface along a circular shaped cap and an arrangement for attaching a rod member thereto.

Any of numerous means may provide an arrangement by which each rod member can be attached to a cap or stopper to permit a swinging motion by which the suspended masses 60 can strike the wall 11 of a bottle. According to a fifth embodiment 14*c* of the noise-making assembly, FIG. 5 is a perspective view showing the interior surface 58 along the top 44/92 of a circular shaped cap 40/106. A second end 74' of a rod member 64 includes a T-shaped end, comprising a cross member 112 attached to the rod member. A pair of hangers 120 is affixed to the interior surface 58 of the circular shaped cap top 44/92 to receive opposing ends 112*e* of the cross member 112. By so positioning the cross member 112 to hang from a cap or a stopper, the rod member 64 may freely swing. Thus, when the assembly 14*c* is inserted within a bottle 12, the mass 60 can be swung to repeatedly strike the wall 11 of the bottle 12. Multiple rod members having T-shaped second ends (e.g., each having a cross member 112) can be attached to one pair of hangers 120 or attached to separate pairs of hangers 120 so that a noise-making assembly comprises two or more masses 60.

Figure 6:
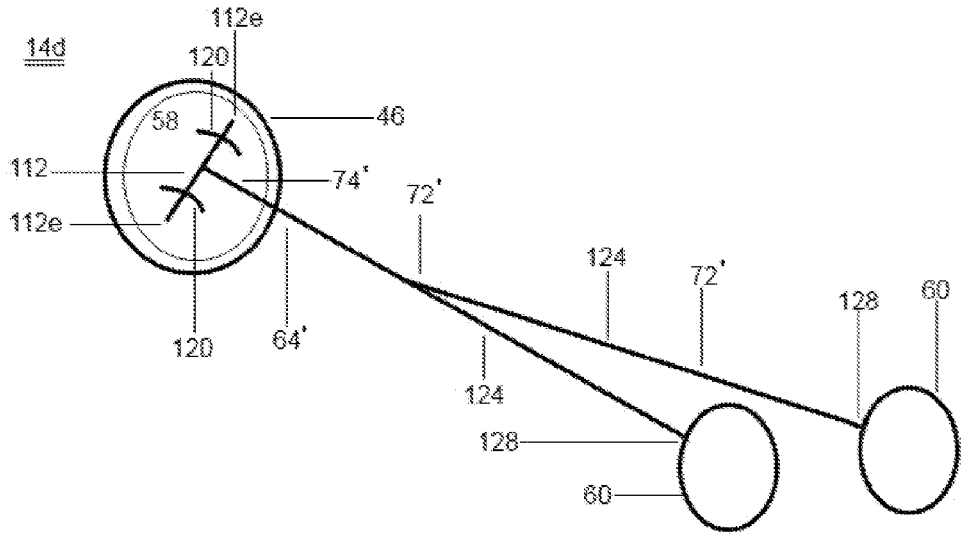
FIG. 6 is a perspective view of still another embodiment of an assembly according to the invention showing an interior surface 58 along a circular shaped cap and an arrangement for attaching a bifurcated rod member.

According to a sixth embodiment 14*d* of the noise-making assembly, the perspective view of FIG. 6 illustrates the interior surface 58 along the top 44/92 of a circular shaped cap 40/106. The assembly includes a bifurcated rod member 64'. As for the second end 74' of the rod member 64 of the embodiment 14*c*, the rod member 64' of the assembly 14*d* includes a second end 74' having a T-shaped end, e.g., having a cross member 112 for attachment to a pair of hangers 120 affixed to the interior surface 58 of a circular shaped cap top 44/92 to receive opposing ends 112*e* of the cross member 112. In lieu of the first end 72, the bifurcated rod member 64' includes a first end 72' which branches into two rod member segments 124. A mass 60 is attached to an end 128 of each segment 124. With the embodiment of FIG. 6 two or more masses may be attached to each rod member 64' for positioning in the bottle 12. This arrangement permits options of forming a noise-making assembly with a single rod member while providing two masses 60, or forming a noise-making assembly with multiple rod members each comprising two or more masses 60.

The rod members 64, 64' shown in FIGS. 1-6 have been illustrated schematically, without specific design details, in order to illustrate the rod members as functional components of a noise-making assembly with generality. However, it is to be understood that the illustrated rod members may comprise numerous additional features when incorporated in a variety of embodiments of noise-making assemblies according to the invention.

Figure 7A:
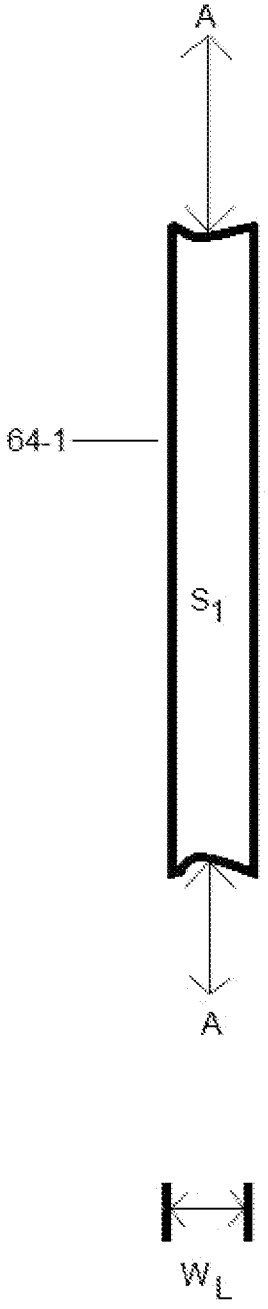
FIGS. 7A and 7B are partial side views of a two sided rod member according to another embodiment of the invention, where
Figure 7B:
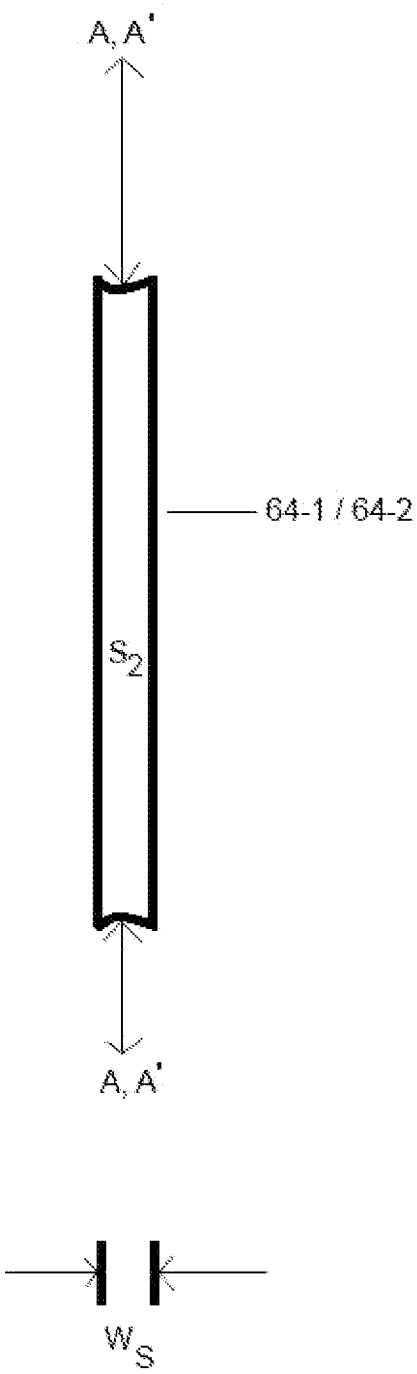
Figure 7C:
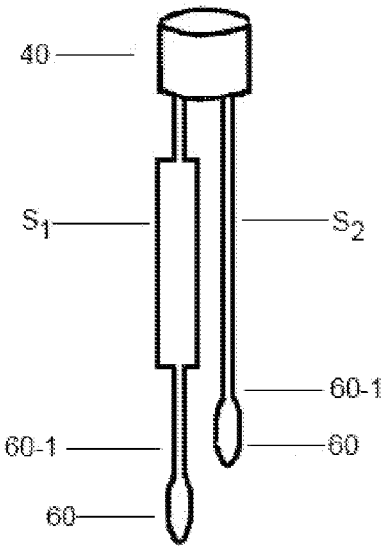
FIG. 7C is a perspective view of an assembly illustrating two rod members as illustrated in FIGS. 7A and 7B, each connected to a cap and one of the masses shown in FIG. 1.

FIGS. 7A and 7B are partial side views of embodiments of the rod members 64, 64' which are shown as two sided rod member 60-1 attachable to a cap or stopper along the second end 74. FIG. 7A is a view taken along a major axis, A, of the rod member to illustrate a major side $S_1$, having a relatively large width, $W_L$. FIG. 7B is a view also taken along the major axis, A, of the rod member with the member 64-1 having been rotated ninety degrees about the major axis, A, relative to the view of FIG. 7A, to illustrate a minor side, $S_2$, having a relatively small width, $W_S$. The major sides $S_1$ of the rod member 64-1 are relatively wide to permit placement of text or logos or other information thereon. FIG. 7C is a perspective view of an assembly illustrating two rod members 60-1, each connected to a cap 40 and one of the masses 60 shown in FIG. 1.

Figure 7D:
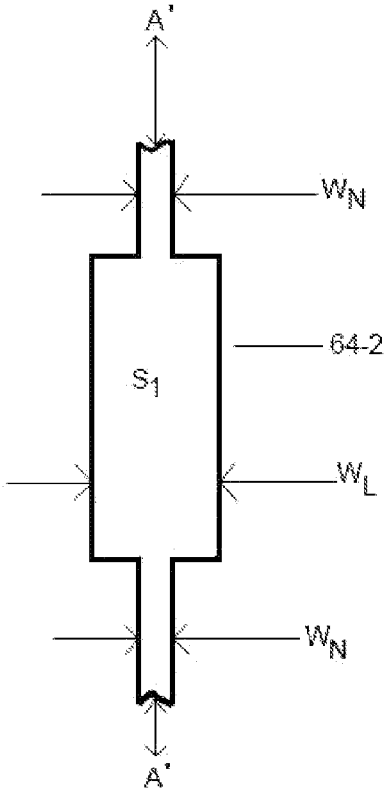
FIG. 7D provides a side view of a rod member according to another alternate embodiment of the rod member to illustrate a major side having a relatively large width, $W_L$ along a central portion of the rod member and a relatively narrow width $W_N$ along other portions of the major side.
Figure 7E:
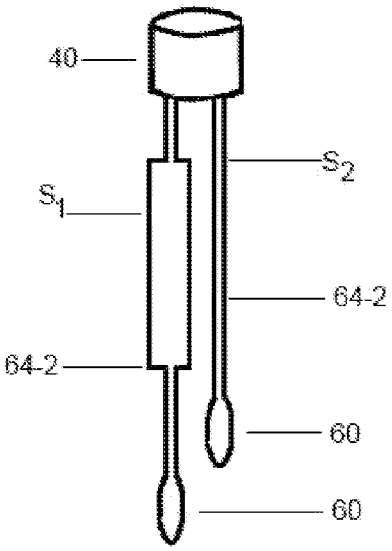
FIG. 7E is a perspective view of an assembly illustrating two rod members as illustrated in FIGS. 7D and 7B, each connected to a cap and one of the masses shown in FIG. 1.

FIG. 7D illustrates a side view of a rod member 64-2 according to an alternate embodiment, taken along a major axis, A', of the rod member to illustrate a major side $S_1$, having a relatively large width, $W_L$ along a central portion of the rod member and a relatively narrow width $W_N$ along other portions of the member 64-2. The major sides $S_1$ of the rod member 64-2 are relatively wide to permit placement of text or logos or other information thereon. With the member 64-1 rotated ninety degrees about the major axis, A', relative to the view of FIG. 7D, the minor side, $S_2$, having a relatively small width, $W_S$ is also illustrated in FIG. 7B. FIG. 7E is a perspective view of an assembly illustrating two rod members 64-2, each connected to a cap 40 and one of the masses 60 shown in FIG. 1. Although the rod members 64-1 and 64-2 are shown to be formed of varied widths and thicknesses, it is to be understood that the rod members may be shaped to depict two dimensional or three dimensional images and may include relief surfaces. Generally, the rod members may incorporate branding or advertising information.

Figure 7F:
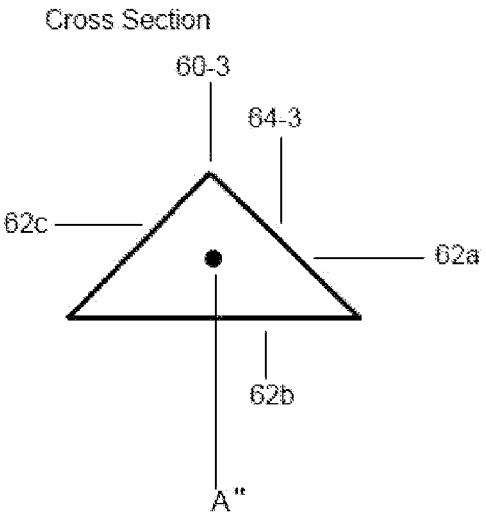
FIG. 7F is a view of a rod member according to still another design, with the view taken through a central axis, showing that rod members according to the invention may have three or more sides.

In another series of example rod member designs, FIG. 7F is an end view of a rod member 64-3 which extends through a central axis, A", of the rod member, showing that the member has three sides 62*a*, 62*b*, 62*c*, each suitable for lettering, branding, advertising, etc. Generally, the rod members may have three or more sides.

Figure 8A:
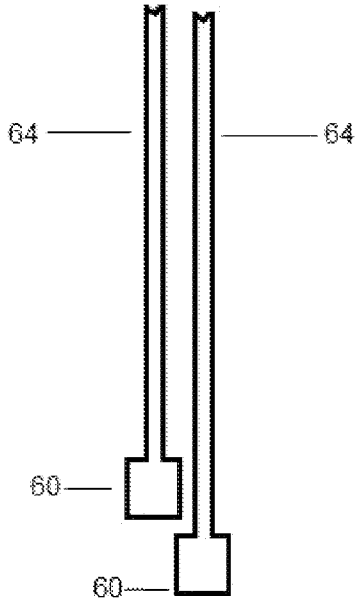
FIGS. 8A through 8G illustrate a variety of shapes suitable for the masses 60 shown in FIGS. 1-7.
Figure 8B:
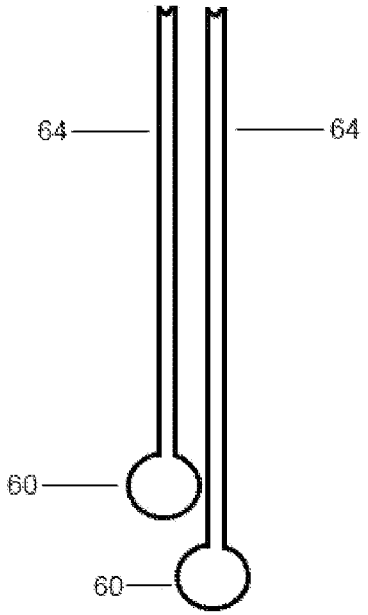
Figure 8C:
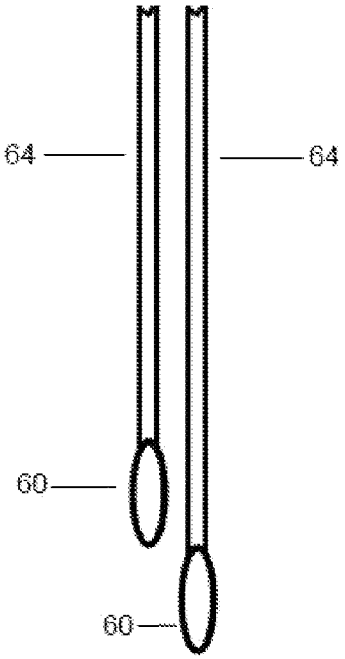
Figure 8D:
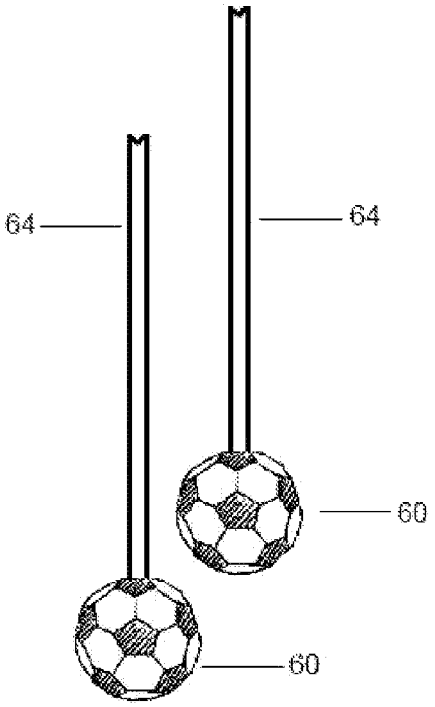
Figure 8E:
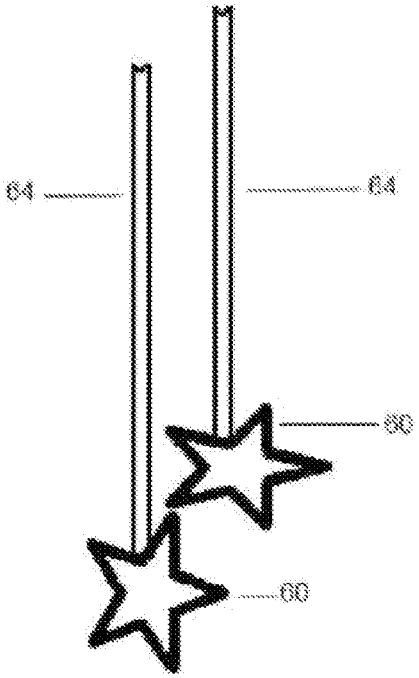
Figure 8F:
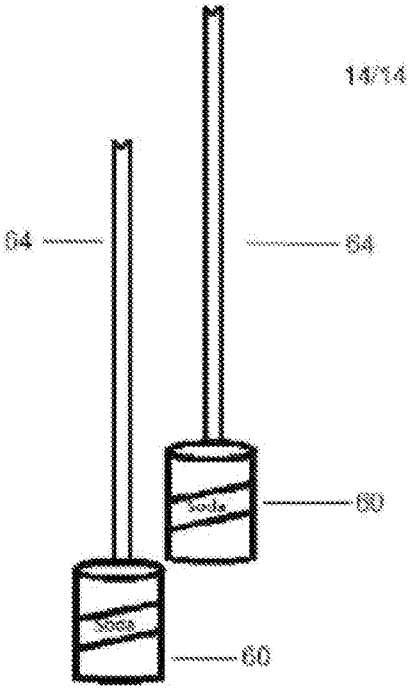
Figure 8G:
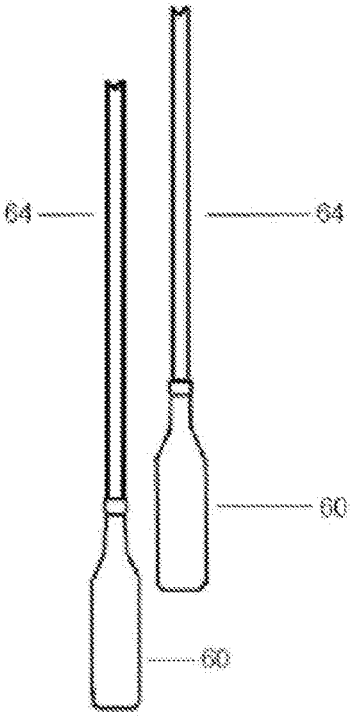

The masses 60 shown in the Figures have been illustrated schematically, without specific design details, to generally illustrate components of a noise-making assembly. The masses 60 may be solid or hollow spherical shapes which may swing in a repetitive pattern by which the masses strike the wall of a bottle to generate an impulsive sound. In other embodiments, the masses 60 may be of a common geometric shape. FIG. 8A illustrates a pair of masses 60 each having a three dimensional cube shape while FIG. 8B illustrates a pair of masses 60 each having a ring-like shape. FIG. 8C illustrates a pair of masses 60 each having an oblong or elliptical shape. Generally, the masses 60 may have any shape, e.g., a spherical shape. The masses 60 may also be three dimensional reproductions of symbols (e.g., mascots or sporting equipment), characters, trademarks, trade dress, company logos, or commercial products. See, for example, FIG. 8D which illustrates the masses formed as replicas of soccer balls or footballs and FIG. 8E which illustrates the masses 60 in the shapes of stars. The masses 60 may also be formed as two or three dimensional replicas of commercial products such as canned or bottled drinks or other symbols. See FIGS. 8F and 8G.

According to embodiments of the invention the rod members 64 may range in stiffness, from being relatively stiff members, that do not easily bend under the inertial forces generated when the masses swing, to being relatively flexible members similar to cord or filament. However, if the rod members are too flexible (e.g., like string) the masses 60 may undergo motion different from swinging about a hinge point (e.g., the attachment point of the rod member) and may travel toward the cap when the bottle is inverted. String may be a less desirable means of suspending the masses 60, especially when two or more masses are suspended from the cap by separate means, because multiple strings may become intertwined. The rod members may be formed of a variety of common materials, including plastic, metal and wood, and may have a variety of shapes or profiles (e.g., flat, round, triangular).

The noise-making assembly has been described in conjunction with a bottle having an opening 22 at the first end 26 near where the neck region 18 terminates and the bottle may include a closed end 24 bounding the container portion 16 or an open end 24'. The noise-making assembly may include the container, but it is not limited to use in containers. More generally, the exemplary bottle 12 is a form of a tube having a closeable first end 26 and an open, closed or closeable second end 24. According to other embodiments of the invention, noise-making assemblies according to the invention may be positioned in tubes of varied shapes but generally having an opening at the first end 26 and, optionally, an opening at an opposing end thereof. As has been shown in FIGS. 1D and 1E, the assembly may be positioned in an open chamber resembling the bottle 12 wherein the chamber does not include a closed end 24 bounding the container portion.

In one series of embodiments of the invention, once the noise-making apparatus is inserted into a tubular structure having two open ends, the combination may include a cap which closes one end and the other end may remain open. In another series of embodiments once the noise-making apparatus is inserted into a tubular structure having one open end, the combination may include a cap which closes the one open end, this resulting in a closed chamber in which the rod members and masses of the noise-making apparatus are enclosed. However, the first end does not have to be closed in order to practice the invention.

Manufacturing of an apparatus according to the invention can be had by a variety of methods and materials used in manufacture may be, but are not limited to rubbers, plastics, metals and hybrid component materials. Specific methods used to manufacture the assembly include, but are not limited to the following:

1. Injection molding (e.g., one step molding manufacturing process).
2. Extrusion molding (which may be used in volume production) for individual components or for a combination of components which have been described as discrete from one another.

If the manufacture involves assembly of discrete components, the assembly process may include separate molding of two or more parts which are assembled together by, for example, one or more of the following processes: ultrasonic or sonic welding; solvent or chemical welding, hot gas welding, heat sealing, freehand welding, speed tip welding, extrusion welding, contact welding, hot plate welding, high frequency welding, injection welding, friction welding, spin welding, laser welding, or plastic welding.

While several embodiments of the present invention have been shown and described herein, such embodiments are provided by way of example only. Numerous variations, changes and substitutions may be made without departing from the invention herein. Accordingly, it is intended that the invention be limited only by the spirit and scope of the appended claims.

The claimed invention is:

1. An apparatus for use with a tube structure having first and second opposing ends, at least the first of the ends of the tube structure including an opening that can be covered, the structure including a wall which extends from the first end to the second end, the tube structure occupying an erect position when the first end is above the second end, the apparatus including:

a cover piece configured to be removably attached along the first of the ends to cover or close the opening by placement of the cover piece in or about the opening;

at least a first rod member having first and second opposing ends, the first rod member end having a direct connection to the cover piece without any other structure there between, said connection between the first rod member end and the cover piece being a fixation point of attachment at the removable cover piece, this enabling pivotal movement of the rod member with swinging motion about the fixation point of attachment of the rod member to the removable cover piece, with the second rod member end positioned away from the cover piece; and a first mass attached to the second end of the rod member, so that the first mass is connected to the cover piece by only a single rod member and wherein, with the mass connected to the rod member:

(i) the first mass and the rod are only removeable from the tube structure by removing the cover piece from the tube structure; and (ii) when the second rod member end and the mass are positioned within the tube structure, both the single rod member and the mass can be swung based solely on pivotal movement about the fixation point of attachment at the cover piece, causing the mass to hit the wall, wherein the rod member has sufficient stiffness under inertial forces to limit travel by the mass toward the cover piece when the tube structure is in a non-erect orientation.

2. The apparatus of claim 1 wherein the first end of the rod member is attached to the cover piece so that, when the cover piece is attached to the opening, with the mass and the rod member positioned within the tube structure, and the tube structure is grasped along or near a portion of the tube structure relatively far from the second end of the rod member but relatively close to the first end of the rod member:

a characteristic of the rod member or a characteristic of attachment of the rod member to the cover piece enables the rod member second end to swing within the tube structure, allowing the mass to collide with the wall of the tube structure.

3. The apparatus of claim 1 further comprising:

at least a second rod member having third and fourth opposing ends, the third rod member end attached to the cover piece and the fourth rod member end positioned away from the cover piece; and at least a second mass attached to the fourth end of the second rod member, wherein the first rod members are of sufficient stiffness that when one rod member swings within the tube structure the first and second rod members do not become intertwined.

4. The apparatus of claim 1 wherein the first rod member comprises a material taken from the group consisting of plastic, metal and wood material.

5. The apparatus of claim 1 wherein the first rod member is formed in a shape which provides at least one flat surface having lettering or a symbol formed thereon.

6. The apparatus of claim 1 wherein the shape of the first rod member is triangular, providing multiple sides each of which contains lettering or a symbol formed thereon.

7. The apparatus of claim 1 wherein the mass is formed in the shape of a ball, a die or a hoop, or the mass has an oblong or ellipsoidal shape.

8. The apparatus of claim 1 further including the tube structure.

9. The apparatus of claim 1 further including the tube structure, wherein the tube structure is a container having an opening at the first end suitable for dispensing a liquid from the container and wherein the second end is a closed end enabling the container to hold a liquid.

10. The apparatus of claim 9 wherein:

the container is a plastic bottle which includes a relatively narrow neck extending from near the first tube end into a relatively wide container portion adjoining the second tube end;

the first end of the bottle is threaded; and the cover piece is a threaded cap which can be fastened to the first end by mating of the threaded cap with the threaded first end of the bottle.

11. The apparatus of claim 1 wherein the tube is a bottle and the cover piece is a cork stopper, a rubber stopper or other form of a deformable mass which fits within the opening at the first end of the bottle and, when the cover piece is fit within the opening at the first end of the bottle, the rod member extends from the cover piece and within the bottle so that the mass is suspended within the bottle.

12. An apparatus for use with a bottle or other tube structure having a wall which extends from a first end of the structure to a second end of the structure, comprising:

a removable cover piece attachable along one end of the structure about an opening of the structure;

a single rod member having one end directly connected to the cover piece without any other structure there between, said connection between the one rod member end and the cover piece being a fixation point of attachment at the removable cover piece, this enabling pivotal movement of the rod member about the point of attachment on the removable cover piece; and a mass attached to a second end of the single rod member, so that the first mass is connected to the cover piece by only one rod member and when the second rod member end and the mass are positioned within the tube structure for said pivotal movement of the rod member within the tube structure:

(i) the mass and the single rod member are only removeable from the tube structure by removing the cover piece from the tube structure; and (ii) when the second rod member end and the mass are positioned within the tube structure, both the single rod member and the mass can be swung within the tube structure based on pivotal movement about the fixation point of attachment at the cover piece, causing the mass to hit the wall, wherein the rod member has sufficient stiffness under inertial forces to limit travel by the mass toward the removable cover piece when the tube structure is in a non-erect orientation.

13. The apparatus of claim 12 wherein:

the tube structure is a plastic bottle which includes a relatively narrow neck extending from near the first tube end into a relatively wide container portion adjoining the second tube end;

the first end of the bottle is threaded; and the cover piece is a threaded cap which can be fastened to the first end by mating of the threaded cap with the threaded first end of the bottle.

14. The apparatus of claim 13 further including the plastic bottle.

15. A method of using a bottle or other tube structure with a mass and a rod as a noise making device, the tube structure having first and second opposing ends and a relatively narrow neck portion extending from near the first end and into a relatively wide portion of the tube structure which adjoins the second end, the method comprising:

connecting a first end of the rod to a cover piece removable from the tube structure, the first rod end having a direct connection to the cover piece without another rod positioned there between, said connection between the first rod end and the cover piece being a fixation point of attachment of the rod to the removable cover piece, this enabling pivotal movement of the rod with swinging motion about the fixation point of attachment of the rod to the removable cover piece with a second rod end positioned away from the cover piece;

attaching a mass to the second end of the rod; and attaching the removable cover piece along the first end of the tube structure and about an opening adjoining the neck portion of the tube structure thereby positioning the second rod end and the mass within the tube structure so that, with said pivotal movement of the rod at the fixation point of attachment, the rod and the mass can be swung within the tube structure at the fixation point of attachment, so that, with the mass connected to the removable cover piece by only the one rod member:

(i) the first mass and the rod are only removable from the tube structure by removing the cover piece from the tube structure; and (ii) when the second rod member end and the mass are positioned within the tube structure, both the one rod member and the mass can be swung based solely on pivotal movement about the fixation point of attachment at the cover piece causing the mass to hit a wall of the tube structure while bending of the rod while the mass is swung is so limited that travel by the mass toward the cover piece is limited relative to travel toward the removable cover piece which would occur if the rod were replaced with a member having flexibility of a string.

16. The method of claim 15 wherein the tube structure is a bottle, the cover piece is a bottle cap and the step of attaching the cover piece is effected with mating threads along the first end of the tube structure and the cover piece, where the cover piece is fastened to the structure by engaging the threads of the cover piece with the threads along the first end of the tube structure.

17. The method of claim 15 wherein, with the first end of the rod member attached to the cover piece and the cover piece attached about the opening so that the mass and the rod are positioned within the tube structure, the method further including:

grasping with a hand the cover piece or the tube structure at a position along the neck portion; and swinging the tube structure by movement of the grasping hand to impart motion to the mass and strike the wall of the tube structure with the mass to generate impulsive sounds.

18. The method of claim 17 wherein the tube structure is swung continuously to create a reciprocating motion of the tube structure that imparts back and forth motion of the masse with respect to the tube structure causing a repetition of impulsive sounds.

19. The method of claim 15 further including the step of selecting a rod member having sufficient stiffness to limit travel by the mass toward the cover piece when the tube structure is in a non-erect orientation.

* * * * *